US005233323A

United States Patent [19]

Burkett et al.

[11] Patent Number: 5,233,323

[45] Date of Patent: Aug. 3, 1993

[54] DEFEAT RESISTANT INTERLOCK/MONITORING SYSTEM

[75] Inventors: Roy A. Burkett; Raul Enriquez; Matthew C. Jones, all of Portland; Joseph L. Shaddix, Forest Grove; William L. Yeldig, Beaverton, all of Oreg.

[73] Assignee: Sentrol, Inc., Portland, Oreg.

[21] Appl. No.: 882,429

[22] Filed: May 13, 1992

[51] Int. Cl.[5] ..... H01H 9/00

[52] U.S. Cl. ..... 335/207; 335/205

[58] Field of Search ..... 340/547; 335/205, 206, 335/207

[56] References Cited

U.S. PATENT DOCUMENTS

| | | | |
|---|---|---|---|
| 2,912,540 | 11/1959 | Sawicki . | |
| 3,305,805 | 2/1967 | Tann . | |
| 3,668,579 | 6/1972 | Harman . | |
| 3,974,469 | 8/1976 | Nicholls . | |
| 4,210,888 | 7/1980 | Holce . | |
| 4,210,889 | 7/1980 | Holce . | |
| 4,213,110 | 7/1978 | Holce . | |
| 4,737,751 | 4/1988 | Risk | 335/207 |
| 4,910,634 | 3/1990 | Pipkorn | 335/205 |
| 4,945,340 | 7/1990 | Bkill | 340/547 |
| 5,047,773 | 9/1991 | Seitsonen et al. | 340/685 |

*Primary Examiner*—Lincoln Donovan

*Attorney, Agent, or Firm*—Marger, Johnson, McCollom & Stolowitz

[57] ABSTRACT

Four magnetically actuable reed switches are configured in a unique biasing configuration and physical arrangement for providing a defeat resistant interlock-/monitoring system with minimal switching circuitry. The switches are physically arranged so that two switches, mechanically biased in a normally closed state, lie between two switches, mechanically biased closed but magnetically biased in an open state, and are mutually perpendicular. The relative positions and orientations of the biased and nonbiased switches require two separate magnetic fields to activate the system. The system is only activated by an actuator which emits the magnetic fields required to actuate only the magnetically biased switches. The actuator magnet fields are oriented in the same direction as the biasing magnet fields. Adjustability of biasing magnets and a minimal number of switches and actuation magnets increase reliability of the system despite variations in actuator position.

17 Claims, 1 Drawing Sheet

DEFEAT RESISTANT INTERLOCK/MONITORING SYSTEM

BACKGROUND OF THE INVENTION

This invention relates generally to increasing the defeat resistance of magnetically actuated sensing devices and more particularly to improving the capability to monitor the position of doors and windows blocking unauthorized access to restricted areas and preventing unauthorized operation of machinery when safety devices have been disabled.

Magnetically actuated switches previously used in security monitoring systems have typically utilized a magnetically actuated reed switch mounted, for example, in the frame of a doorway or window, with conductors leading therefrom to a security system control unit, and one or more magnets mounted on the edge of the door or window for actuating the reed switch. When the actuating magnet approaches the reed switch within a certain distance, determined by the sensitivity of the reed switch and the strength of the actuating magnet, the magnet actuates the reed switch by closing a set of magnetic contacts therein, which sends an electrical signal to a control unit.

In such applications it is desirable to utilize a relatively sensitive switch so that the distance between the switch and its actuating magnet necessary to actuate the switch is not critical, thereby permitting slight variations in the position of the magnet without changing the state of the switch and setting off a false alarm. A previously known improvement on such magnetically-actuated reed switches for increasing their sensitivity uses a small permanent magnet placed close to a reed switch to bias the response of the switch to the presence of an external magnetic field, so that a weaker magnetic switch field is required to actuate the magnet. Adjustable biasing may be achieved, for example, by variation of the distance or angular relationship between the magnet and the longitudinal axis of the reed of a switch, as shown in Nicholls U.S. Pat. No. 3,974,469, and by varying the location of the reed along an imaginary axis parallel to the axis of polarity of the biasing magnet, as shown by Tann U.S. Pat. No. 3,305,805.

Another desirable feature of switches used in security systems is resistance to manipulation or deception by the use of foreign magnetic fields. High-security switches known as "balanced" switches have been developed for this purpose. An example of this "balanced" type of switch device is the model DR-850 switch manufactured by Walter Kidde & Co. of Belleville, N.J. which has two single-pole-double-throw reed switches and a biasing magnet associated with one of them. An actuating permanent magnet is provided whose position is adjustable within its housing so that when properly adjusted the reed switches will be operated to produce a "normal" indication. However, any attempt to defect the system with an externally applied magnet, regardless of its field direction, is alleged to upset the balance of the switches and thereby produce an "abnormal" indication. Such "balanced" high-security switches, however, must be carefully adjusted during their installation to provide proper actuation.

Adjustment of the position of the actuating magnet relative to the switch is critical in the prior art devices adapted for use in security systems, and when seasonal changes in air temperature and humidity cause changes in the alignment of a door to its frame, minor misalignment is often sufficient to cause the device to produce false indications, requiring expensive service calls for realignment of the switch and its actuating magnet.

To increase the adaptability of monitoring system to changing actuator positions, Holce U.S. Pat. No. 4,210,889, uses a biasing magnet for each of three reed switches to bias each switch to the same respective "open" or "closed" position. To increase the defeat resistance of the monitoring system, the relative magnetic polarity of each biasing magnet is alternated in the switching unit. Another defeat resistant monitoring system using biasing magnets is the level 3 safety interlock switch manufactured by Sentrol Co. of Portland, Oreg., assignees of the above-referenced Holce patent. Such high-security switches, however, are still difficult to adjust during installation and in addition require complex switching circuitry. The level 3 switch uses two unbiased parallel reed switches in addition and at an angle to the three biased reed switches of Holce '889, for a total of five reed switches. These switches require an actuator with three magnets of alternating polarity.

Holce and other previously mentioned patents improve the defeat resistance of monitoring systems but do not operate effectively under the unique conditions associated with interlock systems. For example, monitoring systems determine whether or not a door or window has been opened. If a door is opened while the security monitoring system is on, an alarm is activated. Thus, to defeat a monitoring system each switch must be held in a closed position, without activating the alarm, while opening the door. In a safety interlock circuit, however, the goal of the defeat is to cause the switching unit to activate (e.g. to close all switches), with the door already open so the machine can be run in an unsafe condition, that is, with the guard door open. Interlock systems are, therefore, inherently easier to defeat than monitoring systems. For example, in a monitoring system, if an intruder attempts to defeat the system by placing a foreign magnetic field next to the switching unit, he has no indication whether the magnet properly disabled the system. In a interlock system, however, the intruder is notified of a disabled system by the activation of the interlocked machinery. The intruder can thereby move the foreign magnetic field around the switching unit until he properly disables the system. Thus, a switching unit that is highly defeat resistant in a monitoring system may be easily defeated in a safety interlock application. The Holce '889 patent can be readily defeated with persistence. The current Sentrol level 3 unit with 5 reed switches cannot be defeated but has some problems with residual magnetism and crosstalk of magnetic fields which can sometimes lead to latchup, leaving the switch in an actuated condition when the actuator is removed.

In addition, mechanical interlock systems typically operate under harsher environmental conditions than typical monitoring systems. For example, interlock systems are used in mechanical equipment that is frequently dented, bent, and worn to a greater degree than the doors and windows where monitoring systems are typically attached. Also, interlock circuits must operate in dirt, grease, and other contaminants that may alter typical circuit operation. Therefore, an interlock system must be able to operate under a more extreme range of environmental conditions with an actuator that must operate properly at a wider range of distances and alignment configurations.

Accordingly, a need remains for simple defeat resistant magnetic interlock/monitoring system that is adaptable to changes in actuator position and operating environment.

SUMMARY OF THE INVENTION

Therefore, an object of the invention is to increase the ability of magnetic interlock/monitoring systems to resist defeat from foreign magnetic fields.

Another object of the invention is to increase the capacity of a defeat resistant interlock system to operate correctly under a wide range of environmental conditions and interlock actuator alignments.

A further object of the invention is to simplify the circuitry in a magnetic interlock/monitoring system while maintaining a high defeat resistance capability.

The invention uses multiple magnetically actuated reed switches in a unique biasing configuration and physical arrangement that prevent foreign replication of the actuator magnetic field. The switches are connected in series which, in addition to the biasing and physical configuration of the switches, simplifies the switching circuitry and minimizes the number of switches required to provide a highly defeat resistant system.

The switching unit of the interlock/monitoring system comprises four reed switches, two magnetically biased open and two normally closed, mutually positioned for defeat resistance as stated below. Preferably, the switches are connected in series with every other switch magnetically biased in a "open" position; if any one switch is open the system will not activate. The actuator comprises magnets positioned so that when it is moved to a predetermined position (e.g., its position on a door when the door is shut), the state of the two open switches changes to a closed position without affecting the state of the two normally closed switches. Thus, the switching unit becomes activated when the actuator maintains all four switches in closed positions.

The interlock system is arranged so that two nonbiased, normally-closed switches are positioned between two spaced-apart magnetically biased open switches. The system is thereby defeat resistant because any single foreign magnetic field applied to the switching unit, in an attempt to close the two open switches, has a tendency to also change one or both of the normally closed switches to an open position. Changing either non-magnetically biased switch to an open position deactivates the switching unit. Therefore, due to the possible magnetic actuation of the two normally closed switches, individual magnetic fields are required to be placed directly above each magnetically biased switch. The two nonbiased switches are preferably oriented mutually perpendicularly. This prevents system defeat from foreign magnetic fields imposed from different directions, making it even more difficult to actuate the magnetically biased switches without unintentionally actuating a nonbiased switch.

The biasing magnets also serve to increase the adaptability of the interlock system to minor changes in actuator position. For example, by altering the position of the biasing magnets, the reed switches can be biased so that strong or relatively weak externally imposed magnetic fields from the actuator change the open/closed state of the biased switches in the switching unit. Thus, the interlock system is easily adaptable to different operating conditions thereby reducing system maintenance. In addition, since the biased switches are located at opposite ends of the switching unit and separated by a non-magnetically biased reed switch, the magnetic field of each biasing magnet does not affect the magnetic fields of other biasing magnets within the switching unit. Since there are only two magnets in the actuator, separated by a significant distance, the magnetic fields emitted from the actuator also do not affect other switches within the switching unit. Therefore, switches can be easily and more accurately biased for actuation at a wider range of actuator distances.

The foregoing and other objects, features and advantages of the invention will become more readily apparent from the following detailed description of a preferred embodiment of the invention which proceeds with reference to the accompanying drawings.

DETAILED DESCRIPTION

Figure 1:
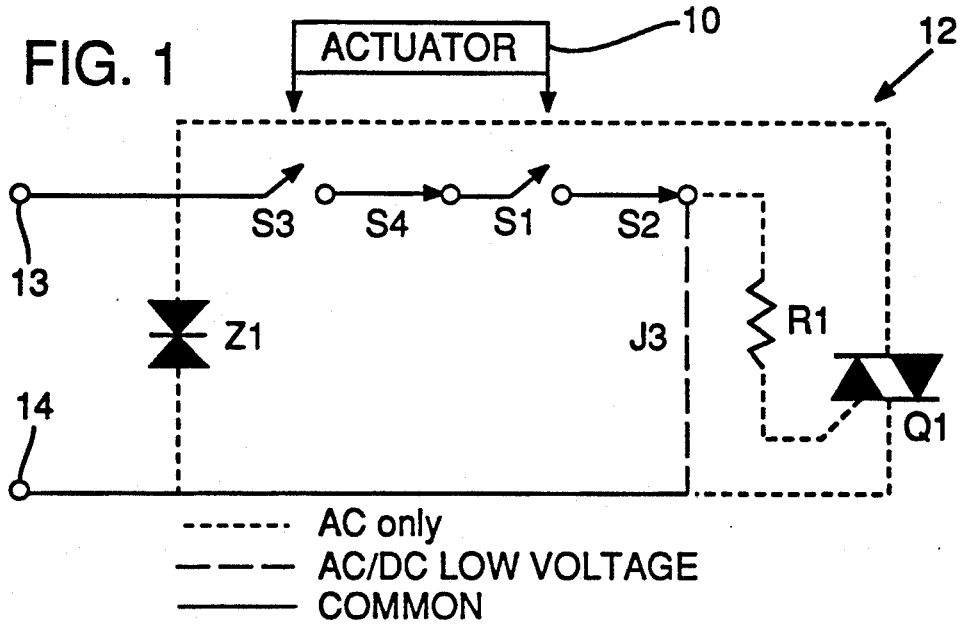
FIG. 1 is a circuit diagram for a defeat resistant magnetically actuated interlock/monitoring system according to the invention.

Referring to FIG. 1, the interlock/monitoring system of the present invention comprises an actuator 10 and a switching unit 12. An electrical signal in a control system (not shown) is coupled through the switching unit at terminals 13, 14. Four magnetically actuated reed switches S3, S4, S1, and S2 are connected in series, respectively, for electrically connecting terminal 13 to terminal 14 only when the switches are all closed.

The reed switches are mechanically biased by their own elasticity to a first (e.g., closed) position and are movable to a second (e.g., open) position responsive to an externally imposed magnetic field. Switches S3 and S1 are also magnetically biased in an open position. Switches S4 and S2 are not magnetically biased and so remain in a normally closed state unless distrubed by an external magnetic field. The normally closed mechanically biased state of the switches and the magnetically biased open state of the end switches S1 and S3 is preferred for a series-wired switching unit but the system can be made equally operational with the states reversed. For example, all switches can be mechanically biased normally open and connected in parallel, with the end switches magnetically biased closed.

The preferred embodiment of unit 12 can be adapted for use in either AC or DC applications, by modifying its interconnections as next described. The solid lines represent conductors common to both AC and DC applications. The long dashed line J3 represents a jumper that is used for low power AC or DC applications and is removable for use in medium power AC-only applications. The short dashed lines represent additional circuitry that is used in the AC-only application. In the AC-only system, resistor R1 resistively couples the gate of triac Q1 in series with switches S1–S4. Triac Q1 is coupled at a first terminal to terminal 13 and is connected at a second terminal to terminal 14. Two back-to-back Zener transistors Z1 couple terminal 13 to terminal 14, in parallel with the triac. Device Z1 serves as a voltage surge protector and could alternatively be a Tranzsorb, metal oxide varistor or equivalent shunting device, or can be omitted.

The switching unit 12 is typically contained within a first housing (not shown) and the housing is, in turn, usually mounted to a door jam, metal cage or the stationary member of the structure in which access is monitored. The actuator 10 is contained within a second housing (not shown), and the housing is, in turn, typically mounted upon the moving member (e.g., door) of the structure. When actuator 10 is moved away from the switching unit (e.g., when the structure door is open), switches S1 and S3 are open and the system is in a deactivated state as indicated in FIG. 1. When actuator 10 is moved toward the switching unit, the switches S1 and S3 are closed to activate the system.

Figure 2:
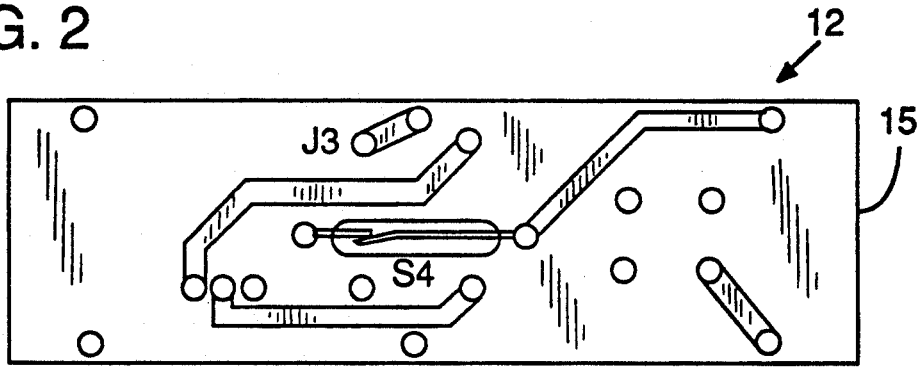
FIG. 2 is a front plan view of a printed circuit board for the interlock/monitoring system of FIG. 1.
Figure 3:
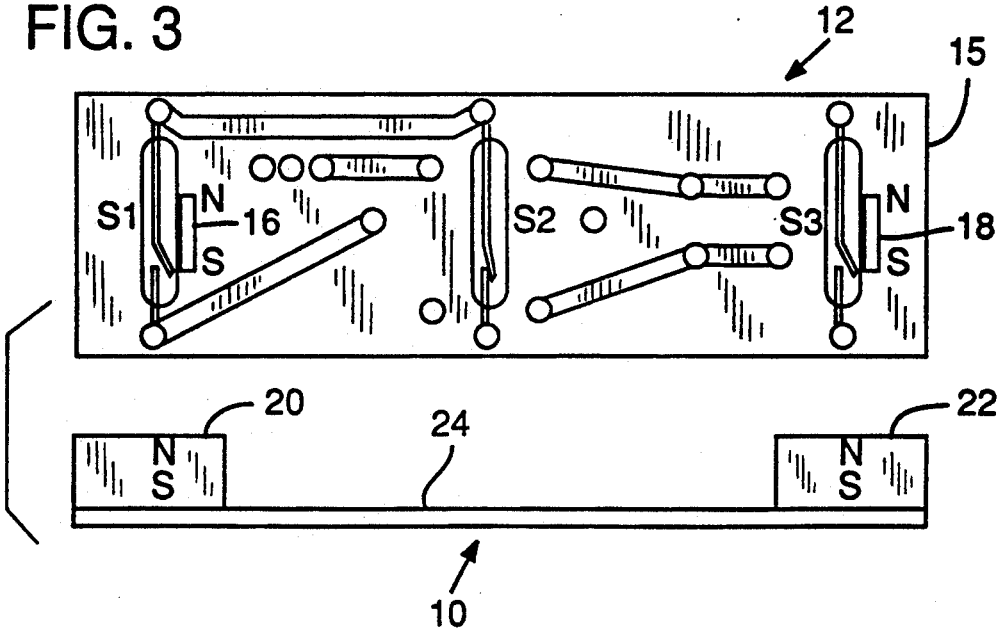
FIG. 3 is a rear plan view of a printed circuit board of FIG. 2, including a magnetic actuator arranged to actuate the magnetically biased switches on the circuit board.

Referring to FIGS. 2 and 3, switches S1–S3 are mounted on the front side (FIG. 3) of circuit board 15 and switch S4 is mounted on the back side (FIG. 2) of board 15. The circuit board is approximately 2.9 inches (7.4 cm.) long and 0.9 inch (2.3 cm.) wide but the length and width are variable for different applications. The preferred reed switches are miniature Form C (single pole/double throw) type switches with the contacts positioned at one end of the glass envelope (e.g., OKI Model ORT 233). The reed switches S1–S3 are mounted flat on the front side of circuit board 15 with the longitudinal axes of switches S1–S3 oriented substantially parallel. Preferably, the switches are oriented parallel to the axes of the magnetic fields of the actuator magnets but they can be canted in the case of larger switches as shown in Sentrol's prior art level 3 interlock. The contact ends of the magnetically biased end switches S1 and S3 are preferably oriented toward the actuator.

Switches S2 and S4 are mounted between switches S1 and S3. The reed switches S1 and S3 and magnets 16, 18 are spaced apart a predetermined distance, e.g., 2.6 inches (6.6 cm.), and switch S2 is spaced between them, such that switches S1 and S3 can be actuated by separate magnetic fields without interfering with switch S2. Switch S4 is mounted flat on the backside of circuit board 15 opposite switch S2 with its longitudinal axis oriented substantially perpendicular to the longitudinal axis of switch S2. Longitudinally magnetized elongated biasing magnets 16 and 18 are located alongside and parallel to switches S1 and S3, respectively. The north poles N of biasing magnets 16 and 18 are positioned next to the stationary contacts of switches S1 and S3, respectively, and the south poles S of biasing magnets 16 and 18 are positioned next to the reed contact of switches S1 and S3. The polarity orientation of the biasing magnets is the same as that of their corresponding actuator magnets 20, 22 (described below). The reed switches are not polarity sensitive. Therefore, the poles of both biasing magnets can be reversed if the corresponding actuator magnets are also reversed.

Since switches S2 and S4 are spaced between switches S1 and S3, and switches S1 and S3 require the same magnetic field to be closed, any single externally imposed magnetic flux that would actuate both of switches S1 and S3 will also actuate at least one of non-magnetically biased switches S2 and S4. For example, if a single magnet long enough to span switches S1 and S3 were used in an attempt to defeat the system (e.g., during a nonactivation state, attempting to bias all switches to a closed position), either switch S2 or switch S4 would be actuated. With either switch S2 or S4 actuated (e.g., open), the switching unit is disabled since no current can flow between terminals 13 and 14.

Actuator 10 includes first and second permanent magnets 20 and 22 mounted on a yoke 24 which is preferably magnetic, e.g., soft steel, but can be nonmagnetic. The magnets have their poles aligned in the same direction, e.g., with both their north poles N facing the switching unit. When the actuator is located in its predetermined activation position, actuator magnets 20 and 22 are mounted with their magnetic axes in the same axial orientation and direction as the magnetic fields of the biasing magnets 16, 18. The actuator magnets are sufficiently separated so as not to actuate switches S2 and S4. Each actuator magnet is laterally aligned approximately coaxially with the combination of its respective switch and biasing magnet. This alignment turns out to be noncritical, which is advantageous both in initial installation and if, over time, the alignment of the actuator and switching unit change, e.g., due to door sag. A presently preferred size of magnets 20, 22 is $0.5\times0.5\times0.375$ inches ($1.3\times1.3\times1.0$ cm.) and spacing of 2.6 inches (6.6 cm.).

Biasing magnets 16 and 18 are selected to provide a magnetic field sufficient to move the normally closed state of switches S1 and S3 respectively to an open state in the absence of an external field from the actuator but to permit the actuator magnets 20 and 22 to control position of the switch contacts when in proximity to the switches. The biasing magnets are adjustably mounted for controlling the maximum distance actuator 10 can be placed away from the switching unit 12 and still change the switching state of switches S1 and S3. For example, the farther that magnets 16 and 18 are moved longitudinally away from the contact ends of switches S1 and S3, respectively, the less magnetic force they apply in biasing the switches to an open state. Thus, the actuator can be placed farther away from the switching unit 12 and still change the state of switches S1 and S3. Alternatively, if magnets 16 and 18 are placed closer to switches S1 and S3, respectively, actuator 10 must be closer to the switching unit to change the states of switches S1 and S3.

The position of biasing magnets 16 and 18 relative to switches S1 and S3 also determines the minimum distance actuator 10 can be placed next to the switching unit 12 and still change switches S1 and S3 into a closed state. For example, at a predetermined distance, the magnetic fields emitted from actuator 10 neutralize or overwhelm the magnetic fields of biasing magnets 16 and 18, thereby allowing switches S3 and S1 to return to their normally closed state. If actuator 10 is moved too close to the switching unit, however, the magnetic field from the actuator can force switches S3 and S1 back into an open state. Therefore, when the biasing magnets are moved closer to their respective switches, the actuator can be positioned closer to the switching unit without biasing switches S1 and S3 back to an open state. Thus, the biasing magnets are effective in setting the minimum and maximum distances (e.g., distance range) at which actuator 10 can activate switching unit 12.

Due to twisting or sagging of the mounting door, or to wear in door hinges, the activation position and alignment of actuator 10 may change over time. For example, when the actuator is in the activation position, the actuator may be closer or farther away from the switching unit than when originally installed. Since the actuator magnets are placed on opposite ends of the actuator unit, and wider than the switch/biasing magnet combinations, the system can operate with slight misalignments. For example, due to the wide separation between switches S1, S2, and S3, if the actuator magnets are misaligned, they are less likely to inadvertently actuate an adjacent switch. In addition, the biasing magnets can be individually positioned for specific actuator alignments to further reduce the chances of system failure.

The number of components required in the interlock system is minimized and the circuit complexity is simplified by the switching arrangement shown in FIGS. 1-3. For example, only two biasing magnets and only four reed switches are used in the system, making manufacturing less expensive than prior devices. The simplicity of the switching unit also reduces the cost of the actuator since only two actuator magnets are needed. This is an improvement over the actuators mentioned above in the prior art which typically require three magnets.

Fewer biasing and actuator magnets also simplify system installation and increase the adaptability of the system to changes in actuator position. For example, if three actuator magnets are used as in the prior art, the magnetic fields emitted from the actuator and the biasing magnets are closer together. Thus, magnetic fields are more likely to overlap in the system, making it more difficult to control switch biasing. More magnetic fields also reduce the adaptability of the system to different mounting structures. For example, if the interlock system is mounted on a metal structure, each magnetic field in the system is more likely to affect adjacent switches, reducing the reliability of the system. A more complicated design as in the prior art also lends itself to potential residual magnetism problems, which are minimized in the present design. This does not, however, preclude the use of additional reed switches. For example, one or more magnetically biased switches might be added to the basic design disclosed herein, at opposite ends of the switching unit, to code individual switches uniquely to individual actuators.

OPERATION

System operation will be described for a typical interlock situation. However, it should be noted that the system is also effective for security monitoring. For example, assume switching unit 12 is mounted on a cage structure surrounding safety bypass circuitry for a mechanical device and that actuator 10 is mounted to the door of the cage. The machinery within the cage should not be operated unless the cage door is closed. A DC or AC control sisnal from a control unit (not shown) is routed through switch unit 12 via terminals 13, 14. While the cage door is open, actuator 10 is distanced from the switching unit 12 thereby allowing switches S3 and S1 to be biased to an "open" position by magnets 16, 18. Thus, the signal path between nodes 13, 14 is opened, thereby disabling the machinery.

In order to operate the machinery, the cage door is shut, moving actuator 10 in a predetermined position adjacent to switching unit 12. The two magnetic fields emitted from actuator magnets 20 and 22, actuate switches S3 and S1 into closed positions, similar to switches S4 and S2. Since both magnets 20 and 22 are sufficiently spaced from switches S2 and S4, both S2 and S4 remain closed. All four reed switches are thereby closed, coupling input terminal 13 to return terminal 14. The control signal can pass between terminals 13, 14 and accordingly allows operation of the machinery.

If there is an attempt to defeat the interlock while the cage door is open, the system operates in the following manner. Typically, a foreign magnet is taped to the switching unit in an attempt to close switches S3 and S1. A magnet positioned with the same polarity orientation as either magnet 20 or 22 and of sufficient flux density to overcome the magnetic fields of both biasing magnets 16 and 18, must also impose a magnetic field over switches S2 and S4. Thus, either or both switches S2 and S4 actuate to a open state removing the signal from return terminal 14. As described above, if current cannot flow between terminals 13 and 14, the control unit (not shown) responds by disabling machinery operation. In the alternative, where the interlock/monitoring system is used in a security application, the control unit activates an alarm. Thus, the system is highly defeat resistant in mechanical interlock applications.

The system generally operates the same when an AC signal from the control unit is applied at input terminal 13. In the AC application, jumper J3 is removed and an AC signal across terminals 13, 14 passes through triac Q1, gated through switches S1-S4. When the system is activated (e.g., switches S1-S4 are in closed states), the signal at terminal 13 passes through switches S1-S4 into the gate of triac Q1. The signal at the gate of triac Q1 allows the AC signal to pass through triac Q1 between terminals 13, 14. If a high voltage transient appears across terminals 13, 14, device Z1 clamps the voltage and shunts current directly across the terminals. Thus, a surge is prevented from damaging triac Q1. When the AC system is deactivated, the AC signal is removed from the gate of triac Q1, turning off the triac and thereby blocking the AC current across terminals 13, 14. Thus, the system described above provides a simple, adaptable means for providing defeat resistant actuation of a magnetic interlock/monitoring device in both AC and DC systems.

Having described and illustrated the principles of the invention in a preferred embodiment thereof, it should be apparent that the invention can be modified in arrangement and detail without departing from such principles. I claim all modifications and variations coming within the spirit and scope of the following claims.

We claim:

1. A defeat resistant interlock system for an electrical system, the system comprising:

first and second magnetically actuable switches mechanically biased to a first switching state and mounted on a circuit board separated by a predetermined distance;

first and second biasing magnets establishing a magnetically biased second switching state of the first and second switches respectively;

an actuator comprising first and second actuator magnets for changing the magnetically biased state of the first and second switches when located in a predetermined position relative to the magnetically biased first and second switches; and third and fourth magnetically actuable switches mechanically biased to a first switching state and mounted on the circuit board in the absence of a magnetic biasing field;

the switches being connected in a circuit and switchable between the first and second states to permit electrical operation of the electrical system only when the actuator is at said predetermined position;

the third and fourth switches being spaced between the first and second switches so that the actuator, when located at said predetermined position, does not change the switching state of the third and fourth switches, and oriented so that the fourth switch is at an angle nonparallel to the third switch.

2. An interlock system according to claim 1 wherein the fourth switch is oriented at an angle nonparallel to the first and second switches.

3. An interlock system according to claim 1 wherein the fourth switch is oriented approximately perpendicular to the first, second and third switches.

4. An interlock system according to claim 1 wherein the third and fourth switches are positioned so as to intersect one another.

5. An interlock system according to claim 1 wherein the third and fourth switches are oriented approximately perpendicular to one another and positioned so as to intersect one another.

6. An interlock system according to claim 1 wherein the first and second switches are mutually parallel and the first and second actuator magnets have magnetic field axes oriented approximately parallel to the first and second switches respectively and aligned therewith when the actuator is located in said predetermined position.

7. An interlock device according to claim 1 wherein the biasing magnets and the actuator magnets have magnetic fields which are oriented in the same direction.

8. An interlock device according to claim 1 wherein the switches are mechanically biased to a normally closed state and are connected in series so that opening any one of the switches creates an open circuit.

9. An interlock device according to claim 1 wherein the biasing magnets are adjustably mounted so as to be positionable lengthwise to control the amount of magnetic force used to bias the first and second switches for changing the minimum and maximum distance that the actuator can be placed to change the switching state of the first and second switch.

10. An interlock device according to claim 1 including protection circuitry for limiting electrical current through the circuit.

11. An interlock device according to claim 1 in which the switches are reed switches having contacts in one end thereof, and the first and second switches are oriented so that the contacts are directed toward the actuator.

12. A magnetically actuated interlock device for an electrical system, the interlock device comprising:

first and second magnetically actuable reed switches mechanically biased to a normally closed switching state and mounted in parallel orientation on a circuit board separated by a predetermined distance;

first and second biasing magnets positioned in parallel relationship alongside the first and second switches respectively to establish a magnetically biased open switching state thereof;

an actuator comprising first and second actuator magnets for changing the magnetically biased state of the first and second switches back to the closed state when located in a predetermined position proximate to the magnetically biased first and second switches; and third and fourth magnetically actuable switches mechanically biased to a normally closed switching state and mounted on the circuit board in the absence of a magnetic biasing field;

the switches being connected in a series circuit operable in the closed state to permit electrical operation of the electrical current flow only when the actuator is at said predetermined position;

the third and fourth switches being spaced between the first and second switches so that the actuator, when located at said predetermined position, does not change the switching state of the third and fourth switches; and the third and fourth switches being oriented so that the third switch is parallel to the first and second switches and the fourth switch is normal to the first, second and third switches and overlies the third switch in approximately intersecting relationship so that an external magnetic field cannot change the switching state of the first and second switches without changing the switching state of either the third or fourth switch.

13. An interlock device according to claim 12 wherein the biasing magnets and the actuator magnets have magnetic fields which are oriented in the same direction.

14. An interlock device according to claim 12 wherein the biasing magnets are adjustably mounted so as to be positionable lengthwise to control the amount of magnetic force used to bias the first and second switches for changing the minimum and maximum distance that the actuator can be placed to change the switching state of the first and second switch.

15. A method for magnetically activating an interlock for an electrical system, the method comprising:

positioning first and second magnetically actuable switches normally biased mechanically to a first switching state at a predetermined spacing;

positioning third and fourth magnetically actuable switches normally biased mechanically to said first switching state between the first and second switches;

magnetically biasing the first and second switches into a second switching state without magnetically biasing the third and fourth switches;

actuating the interlock system by simultaneously locating separate external magnetic fields within a predetermined proximity to the first and second magnetically biased switches so that said first and second switches change back to the first switching state; and mutually orienting the third and fourth switches between the first and second switches so that a single foreign magnetic field cannot change the switching state of the first and second switches without changing the switching state of one of the third and fourth switches.

16. A method according to claim 15 including varying an amount of magnetic force used to magnetically bias the first and second switches to vary a maximum distance that the external magnetic fields can be positioned from the first and second switches and still activate said interlock system.

17. A method according to claim 15 including positioning the biasing magnets and the actuator magnets with their magnetic fields oriented in the same direction.

* * * * *